US011261690B2

(12) United States Patent
Krüger

(10) Patent No.: US 11,261,690 B2
(45) Date of Patent: Mar. 1, 2022

(54) DOWNHOLE METHOD AND SYSTEM FOR PROVIDING ZONAL ISOLATION WITH ANNULAR BARRIER EXPANDED FROM WITHIN AND THROUGH WELL TUBULAR METAL STRUCTURE

(71) Applicant: Welltec A/S, Allerød (DK)

(72) Inventor: Christian Krüger, Zug (CH)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 16/735,934

(22) Filed: Jan. 7, 2020

(65) Prior Publication Data

US 2020/0217170 A1 Jul. 9, 2020

(30) Foreign Application Priority Data

Jan. 8, 2019 (EP) ..... 19150862
Oct. 3, 2019 (EP) ..... 19201290

(51) Int. Cl.
*E21B 33/12* (2006.01)
*E21B 29/00* (2006.01)

(52) U.S. Cl.
CPC ..... *E21B 33/12* (2013.01); *E21B 29/005* (2013.01)

(58) Field of Classification Search
CPC .... E21B 33/12; E21B 29/005; E21B 33/1277; E21B 29/08
See application file for complete search history.

(56) References Cited

U.S. PATENT DOCUMENTS

| | | | | |
|---|---|---|---|---|
| 2,481,637 | A | 9/1949 | Yancey | |
| 5,101,895 | A | 4/1992 | Gilbert | |
| 10,689,941 | B2 * | 6/2020 | Hazel | E21B 43/10 |
| 2006/0065408 | A1 * | 3/2006 | Green | E21B 29/00 166/384 |
| 2010/0132952 | A1 * | 6/2010 | Nicolas | E21B 43/105 166/369 |
| 2011/0000668 | A1 | 1/2011 | Tunget | |
| 2013/0186615 | A1 * | 7/2013 | Hallunbaek | E21B 23/06 166/120 |

(Continued)

FOREIGN PATENT DOCUMENTS

NO 20180152 4/2018

OTHER PUBLICATIONS

PCT Written Opinion for PCT/EP2020/050154.*

(Continued)

*Primary Examiner* — Steven A MacDonald
(74) *Attorney, Agent, or Firm* — Nixon & Vanderhye P.C.

(57) ABSTRACT

The present invention relates to a downhole method for providing a zonal isolation at a predetermined position in an annulus between a wall of a borehole and a well tubular metal structure having a longitudinal extension in an existing well, comprising inserting a downhole tool in the well tubular metal structure, positioning the downhole tool opposite the predetermined position, separating a first section of the well tubular metal structure from a second section of the well tubular metal structure by machining into and along a circumference of the well tubular metal structure, inserting an unexpanded annular barrier between the first section and the second section, and expanding the annular barrier for providing zonal isolation at the predetermined position.

15 Claims, 15 Drawing Sheets

(56) References Cited

U.S. PATENT DOCUMENTS

Figure 1:
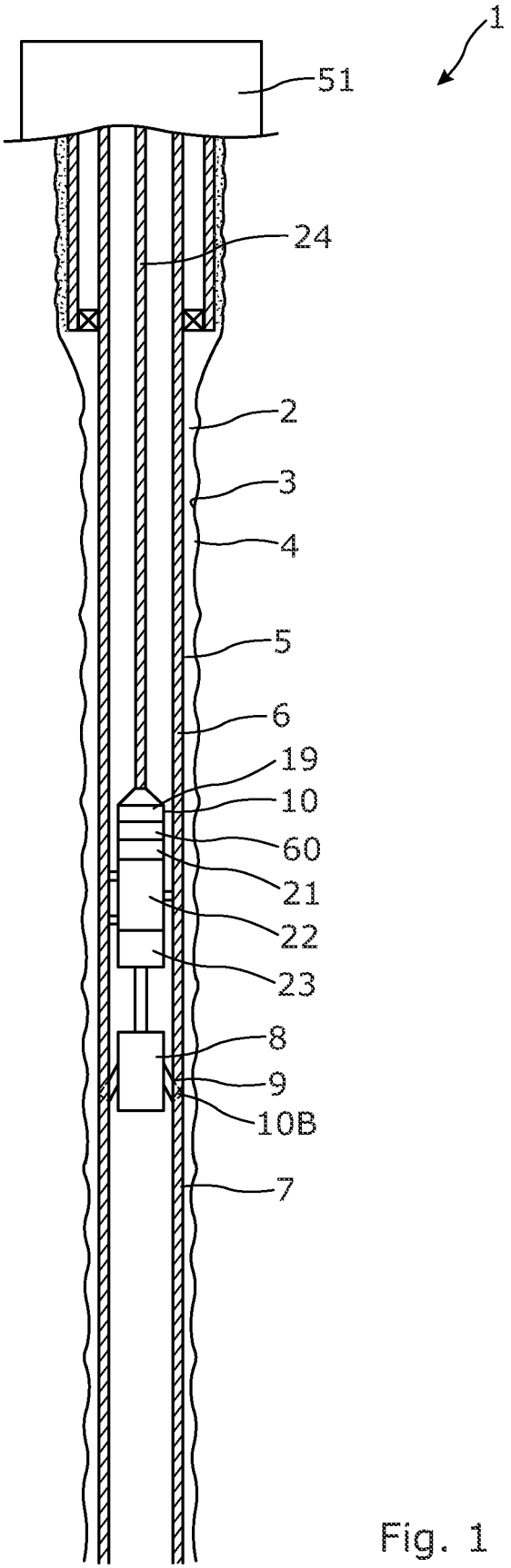

| | | | | |
|---|---|---|---|---|
| 2014/0332232 | A1* | 11/2014 | Hallandbaek | E21B 33/10 166/373 |
| 2016/0024894 | A1* | 1/2016 | Campbell | E21B 33/127 166/278 |
| 2018/0106124 | A1* | 4/2018 | Hazel | E21B 29/00 |
| 2020/0217159 | A1* | 7/2020 | Kruger | E21B 33/138 |
| 2020/0362655 | A1* | 11/2020 | McGarian | E21B 29/005 |

OTHER PUBLICATIONS

Extended Search Report for EP19150862.1 dated Nov. 22, 2019, 5 pages.

Christian Krüger., U.S. Appl. No. 16/735,940, filed Jan. 7, 2020.

Written Opinion of the International Searching Authority with International Search Report dated Apr. 14, 2020 in International Application No. PCT/EP2020/050155, 11 pages.

* cited by examiner

DOWNHOLE METHOD AND SYSTEM FOR PROVIDING ZONAL ISOLATION WITH ANNULAR BARRIER EXPANDED FROM WITHIN AND THROUGH WELL TUBULAR METAL STRUCTURE

This application claims priority to EP Patent Application No. 19150862.1 filed Jan. 8, 2019 and EP Patent Application No. 19201290.4 filed Oct. 3, 2019, the entire contents of each of which are hereby incorporated by reference.

DESCRIPTION

The present invention relates to a downhole method for providing a zonal isolation at a predetermined position in an annulus between a wall of a borehole and a well tubular metal structure having a longitudinal extension in an existing well.

When existing wells do not perform as intended and the production of hydro-carbon containing fluid dwindles from a specific well, or a well produces a high content of water, it is necessary for the operator to decide whether to optimise the well, or if the well should be abandoned.

In order to optimise more simple wells, the zones producing too much water can be isolated e.g. by inserting a patch over a perforated zone or other types of production openings; however, the water from the isolated zone may flow parallelly on the outside of the well tubular metal structure into other producing zones, and with the known solution, it may be difficult to optimise such wells, and these are more likely to be plugged and abandoned, even though some zones may still be producing an acceptable amount of hydro-carbon containing fluid.

It is an object of the present invention to wholly or partly overcome the above disadvantages and drawbacks of the prior art. More specifically, it is an object to provide an improved downhole method capable of optimising also more simple wells in a satisfying manner.

The above objects, together with numerous other objects, advantages and features, which will become evident from the below description, are accomplished by a solution in accordance with the present invention by a downhole method for providing a zonal isolation at a predetermined position in an annulus between a wall of a borehole and a well tubular metal structure having a longitudinal extension in an existing well, comprising

- inserting a downhole tool in the well tubular metal structure,
- positioning the downhole tool opposite the predetermined position,
- separating a first section of the well tubular metal structure from a second section of the well tubular metal structure by machining into and along a circumference of the well tubular metal structure,
- inserting an unexpanded annular barrier between the first section and the second section, and
- expanding the annular barrier for providing zonal isolation at the predetermined position.

The downhole tool may be a wireline downhole tool.

Also, the downhole tool may have a driving unit.

Furthermore, the downhole tool may comprise a machining device, the machining device having at least one arm which is pivotably connected with the downhole tool and has a cutting edge in a first end, the arm being movable between a retracted position and a projected position in relation to the downhole tool.

Separating the first section from the second section may comprise a machining part of the well tubular metal structure over a predetermined distance along the longitudinal extension, thereby grinding the part of the well tubular metal structure.

Moreover, the machining part of the well tubular metal structure may be performed by milling a part of the well tubular metal structure in the longitudinal extension.

Separating the first section from the second section may comprise moving the first section from the second section after the machining.

Separating the first section from the second section may comprise pulling the first section out of the borehole after the machining.

The downhole method may further comprise inserting the first section in the borehole at a distance from the second section.

Inserting the unexpanded annular barrier may be performed by a downhole tool.

The unexpanded annular barrier may be inserted through the first section.

Inserting the unexpanded annular barrier may be performed by mounting the unexpanded annular barrier at an end of the first section. Subsequently, the first section may be inserted into the borehole, so that the unexpanded annular barrier is arranged between the first section and the second section.

Furthermore, the annular barrier may comprise a tubular metal part, an expandable metal sleeve surrounding the tubular metal part, an annular space between the tubular metal structure and the expandable metal sleeve, the tubular metal part having an expansion opening.

Moreover, the annular barrier may comprise an expandable metal sleeve.

The annular barrier may comprise a tubular part and a surrounding swellable material.

Expanding the annular barrier may be performed by a swelling process of the swellable material of the annular barrier.

Expanding the annular barrier may be performed by pressurising at least a part of the well tubular metal structure.

In addition, the pressurising may be performed by a downhole tool isolating a part of the well tubular metal structure.

Furthermore, the pressurising may be performed by pressurising the well tubular metal structure from the surface.

Expanding the annular barrier may be performed by expanding the tubular metal part and/or the expandable metal sleeve.

Expansion of the annular barrier may be performed by means of a mandrel and/or an expandable bladder.

Expansion of the annular barrier may be performed by pressurising the tubular metal part opposite the expansion opening and letting fluid into the annular space for expanding the expandable metal sleeve.

Moreover, the expandable metal sleeve may be radially expanded between the first section and the second section to abut the wall of the borehole.

Additionally, the annular barrier may have a first barrier end and a second barrier end, the first barrier end being configured to overlap the first section and the second barrier end being configured to overlap the second section.

The downhole method may further comprise providing a second zonal isolation at a second predetermined position in the annulus between the wall of the borehole and the well tubular metal structure.

The invention also relates to a downhole system for performing the downhole method as described above for providing a zonal isolation at a predetermined position in an annulus between a wall of a borehole and a well tubular metal structure having a longitudinal extension in an existing well, comprising:

the well tubular metal structure arranged in the borehole, a downhole tool inserted in the well tubular metal structure and positioned opposite the predetermined position for separating a first section of the well tubular metal structure from a second section of the well tubular metal structure by machining into and along a circumference of the well tubular metal structure, and an annular barrier arranged between the first section and the second section and being expanded for providing zonal isolation at the predetermined position.

Figure 2:
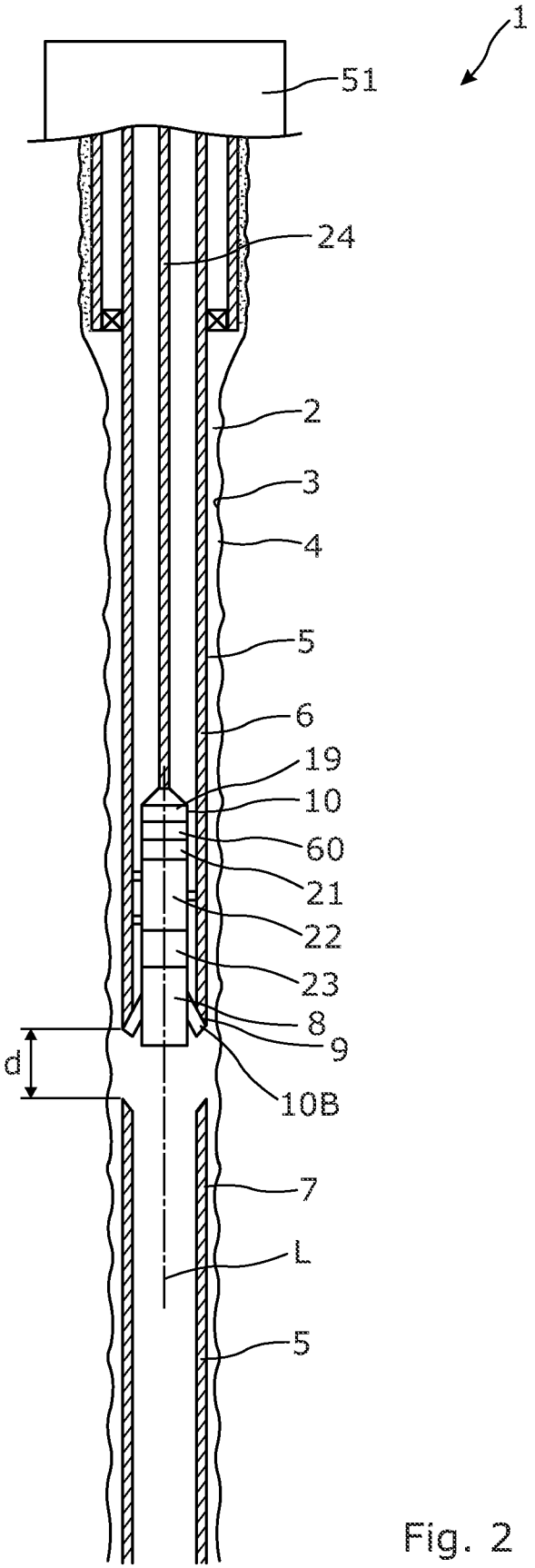
Figure 3:
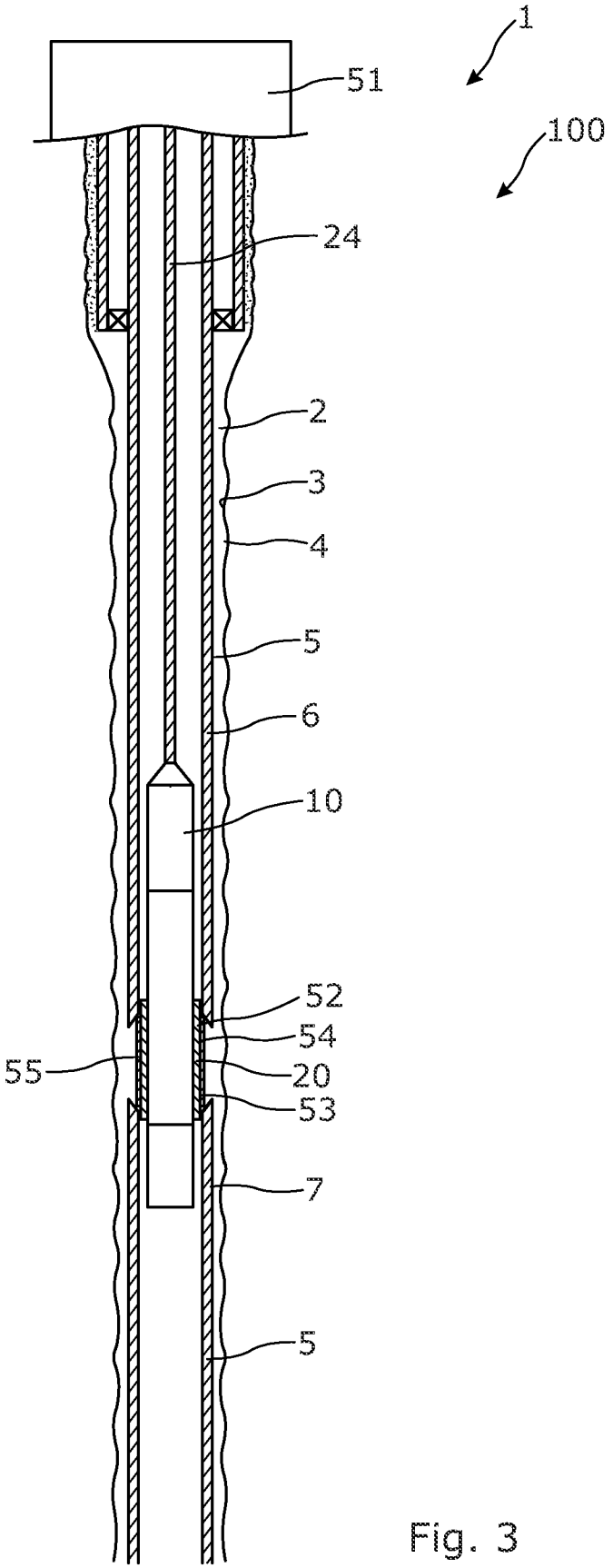
Figure 4:
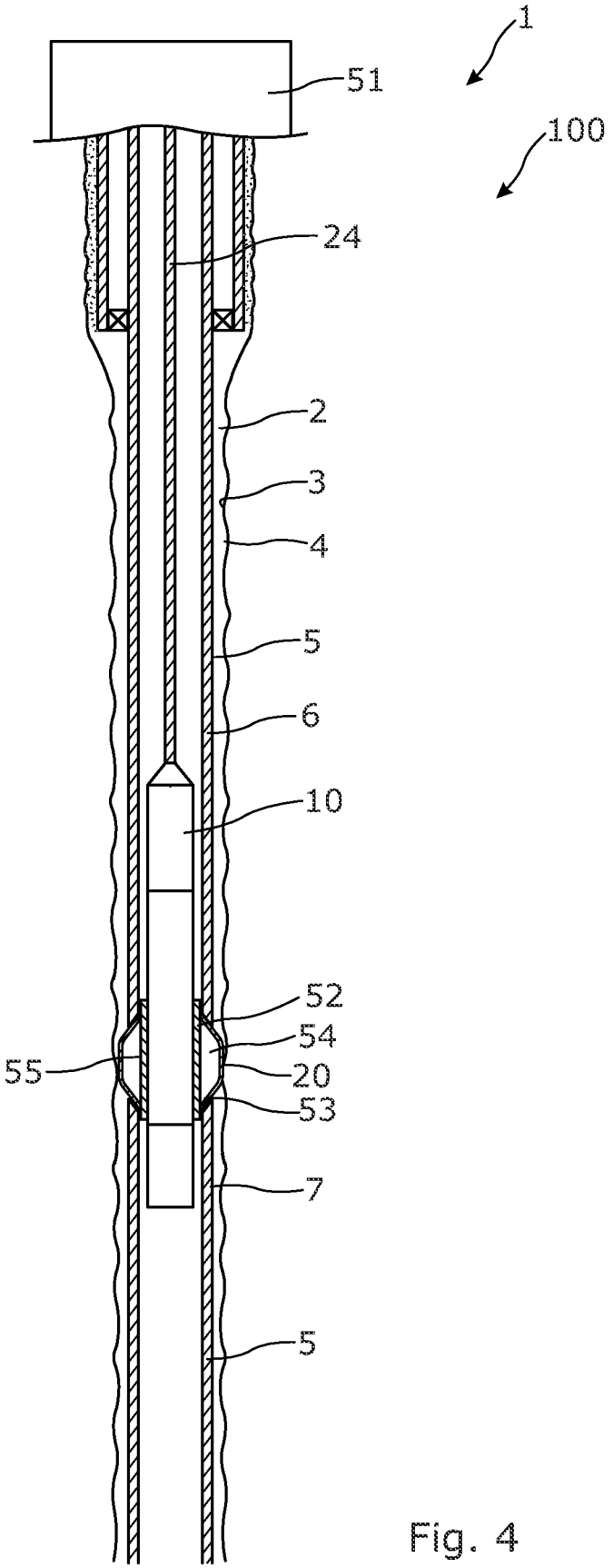
Figure 5:
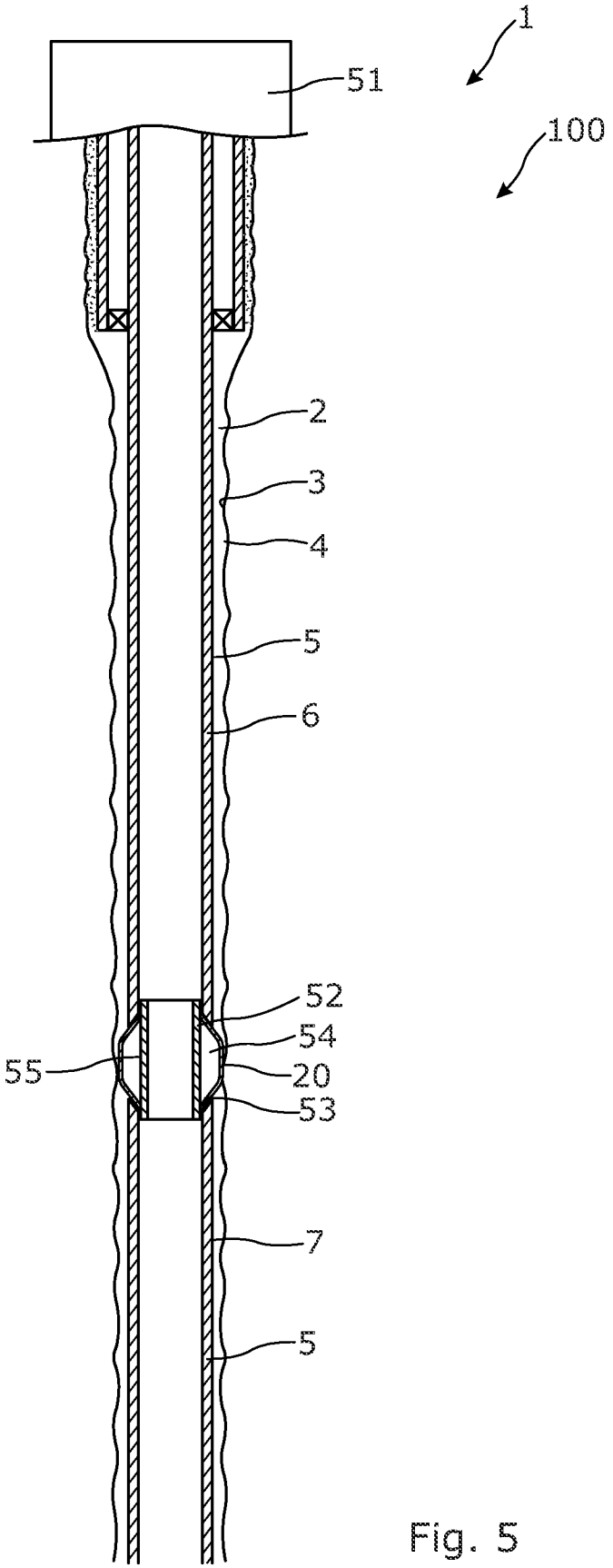
Figure 6:
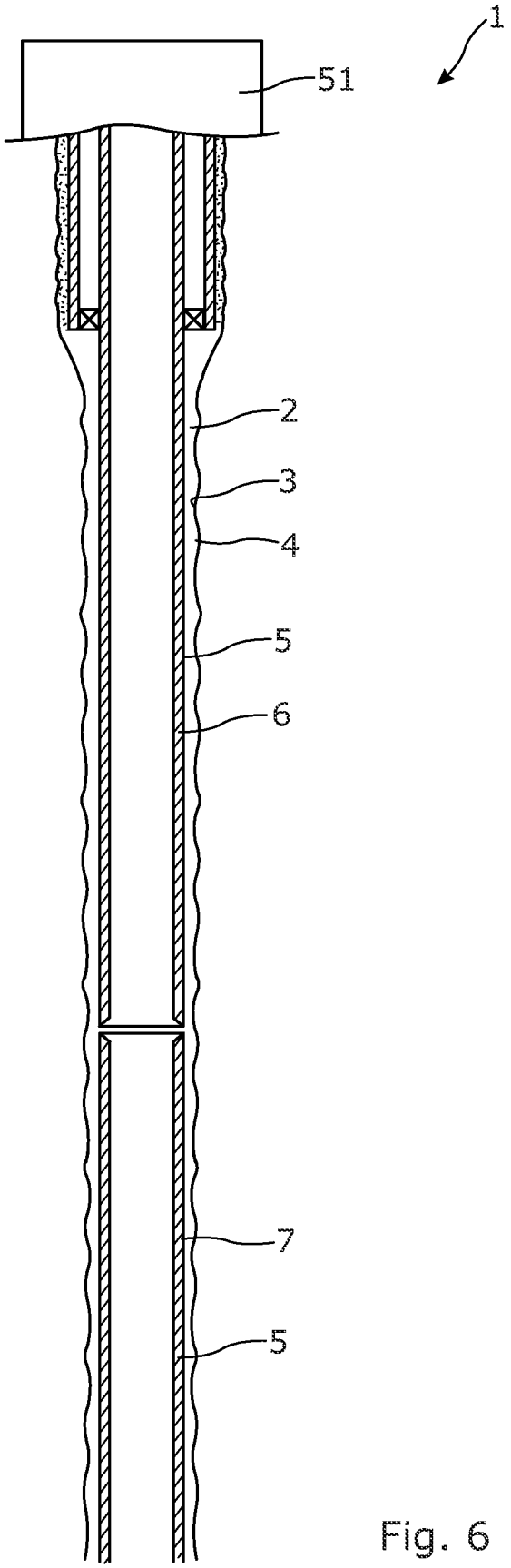
Figure 7:
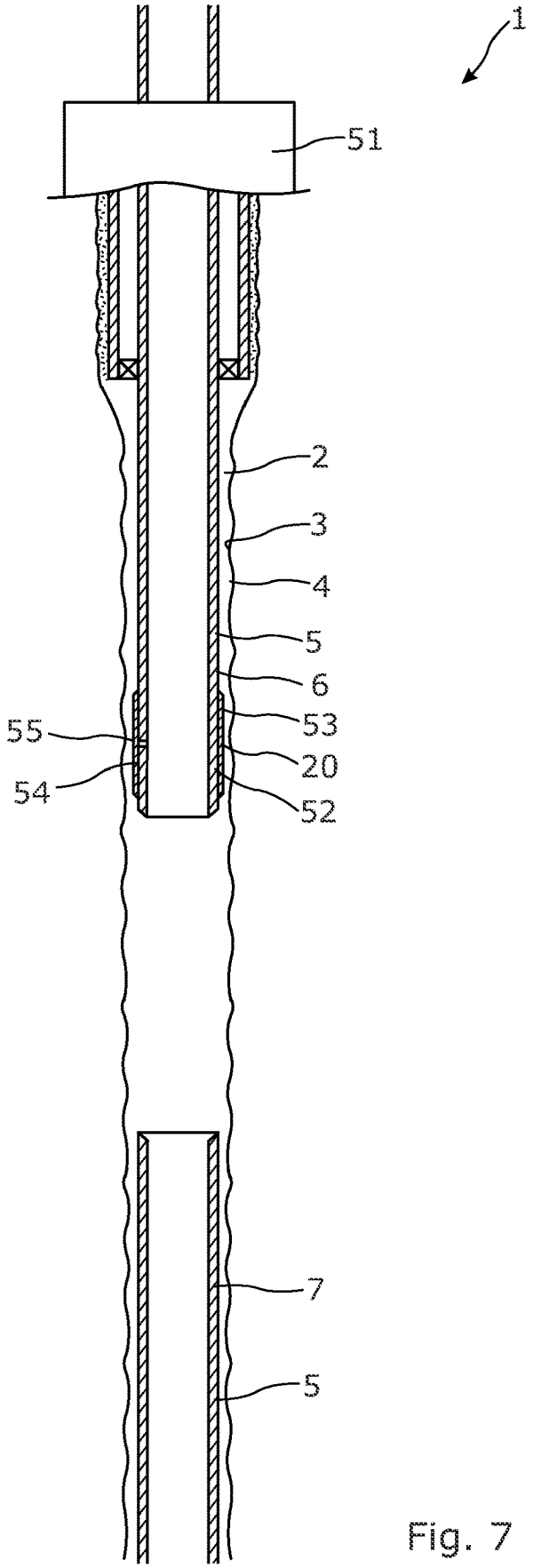
Figure 8:
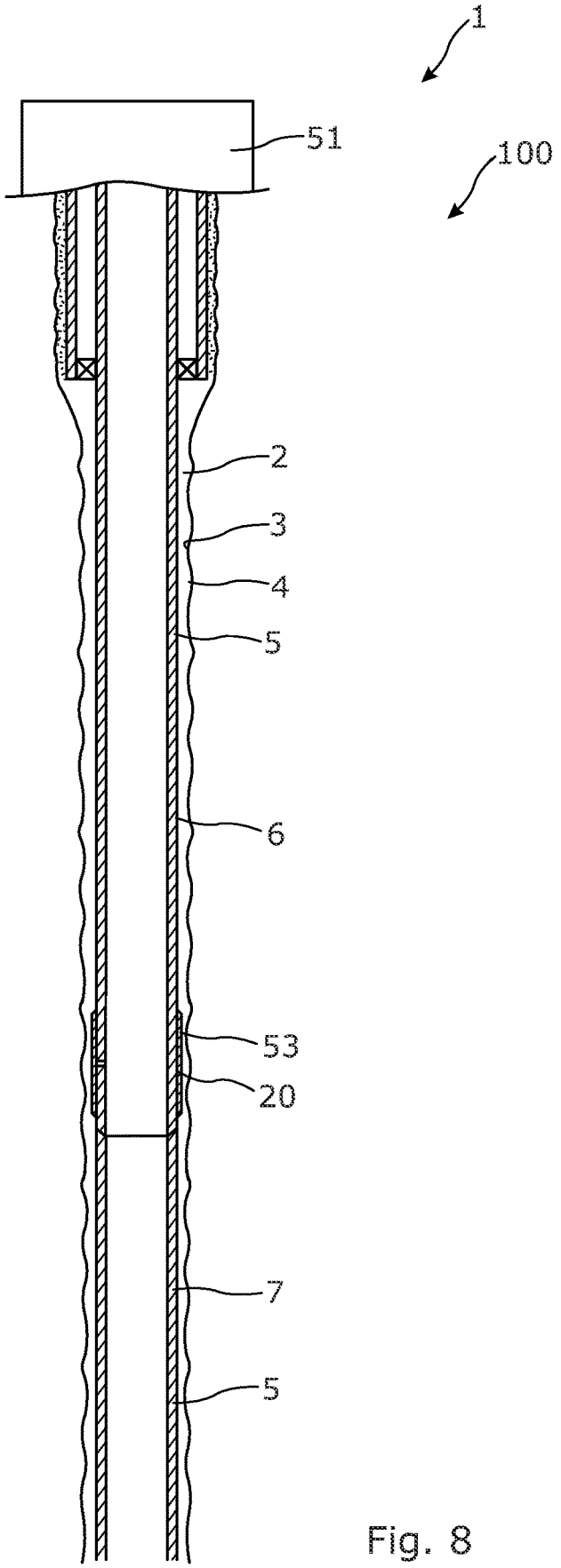
Figure 9:
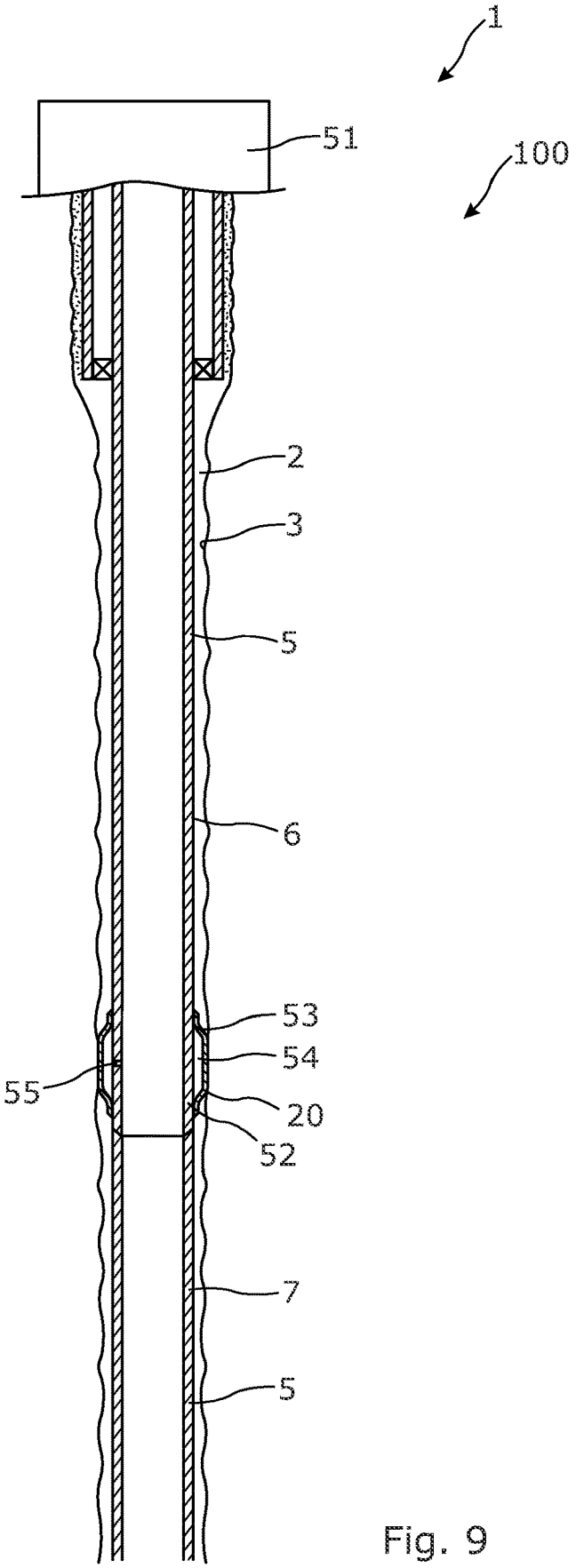
Figure 10:
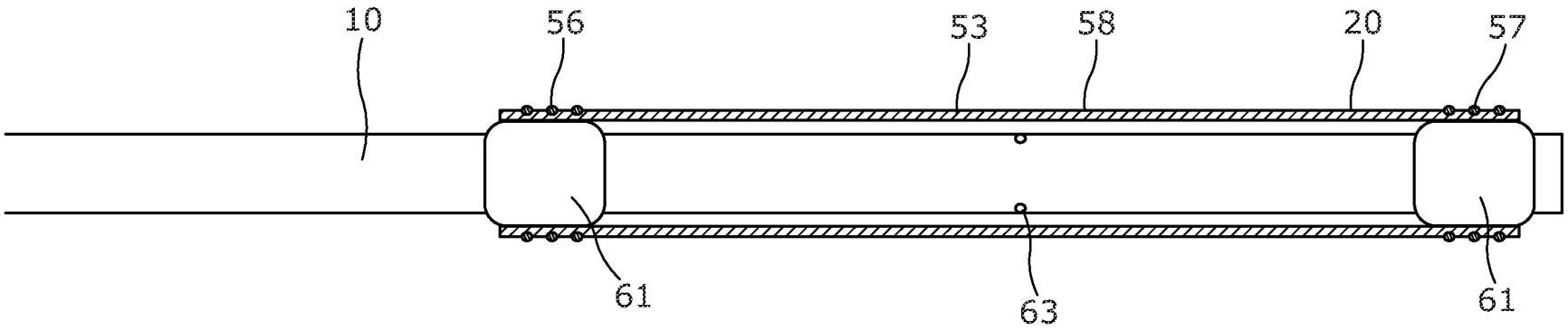
Figure 11:
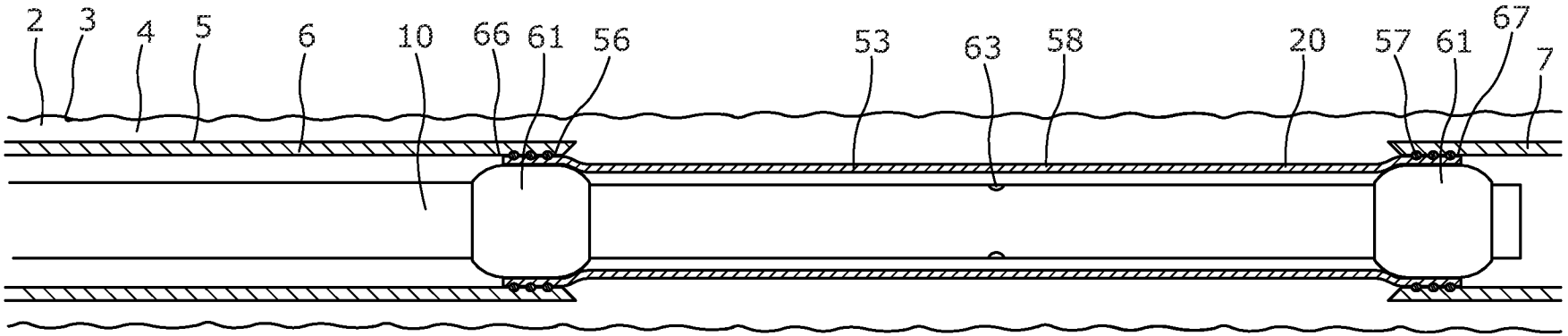
Figure 12:
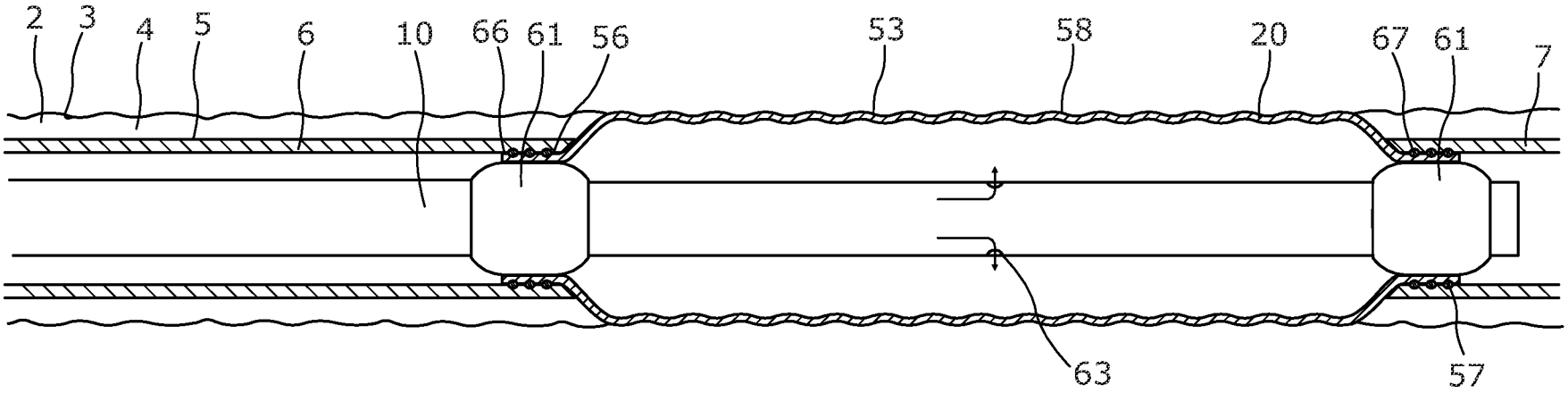
Figure 13:
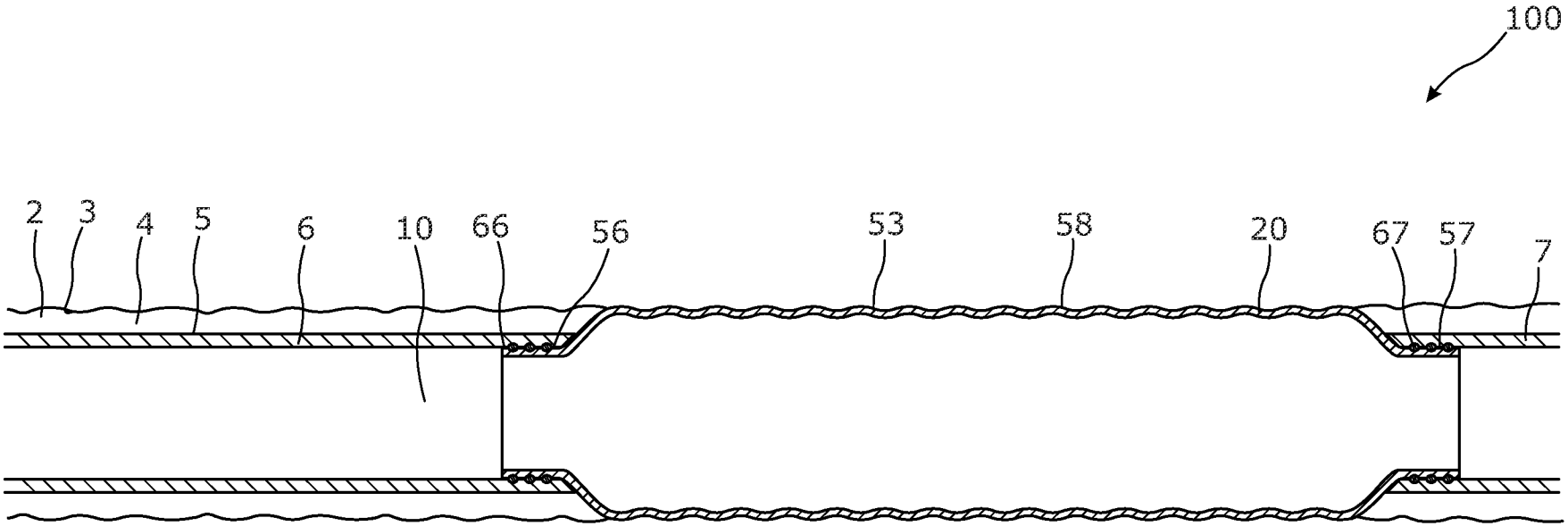
Figure 14:
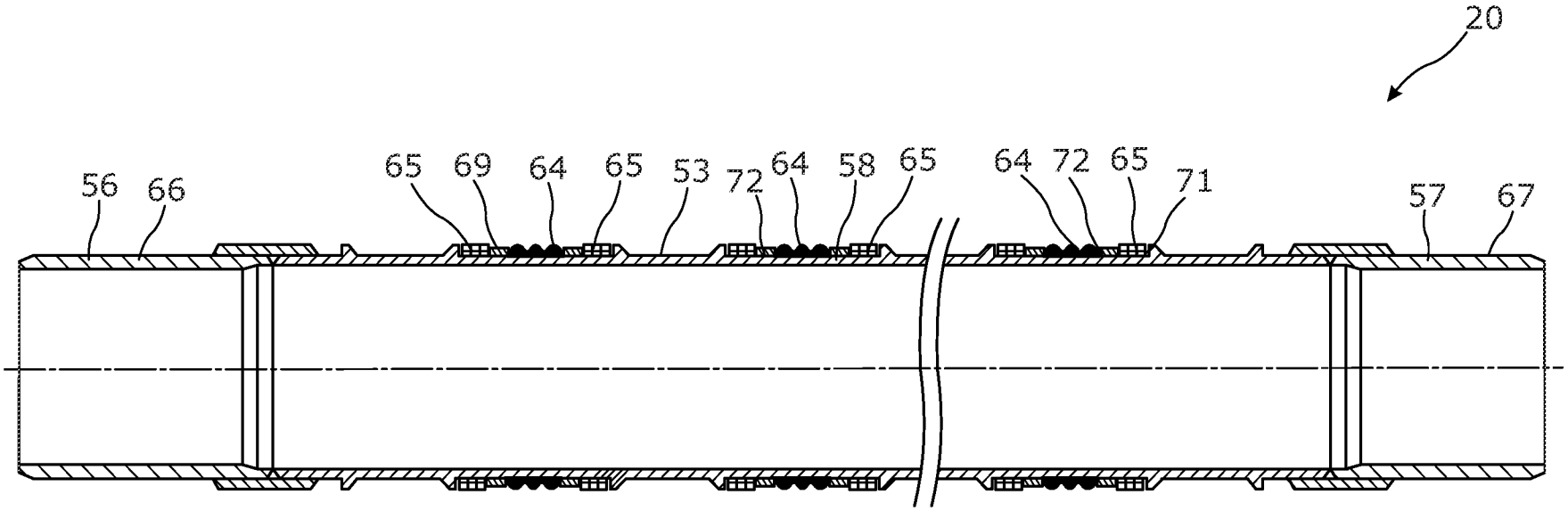
Figure 15:
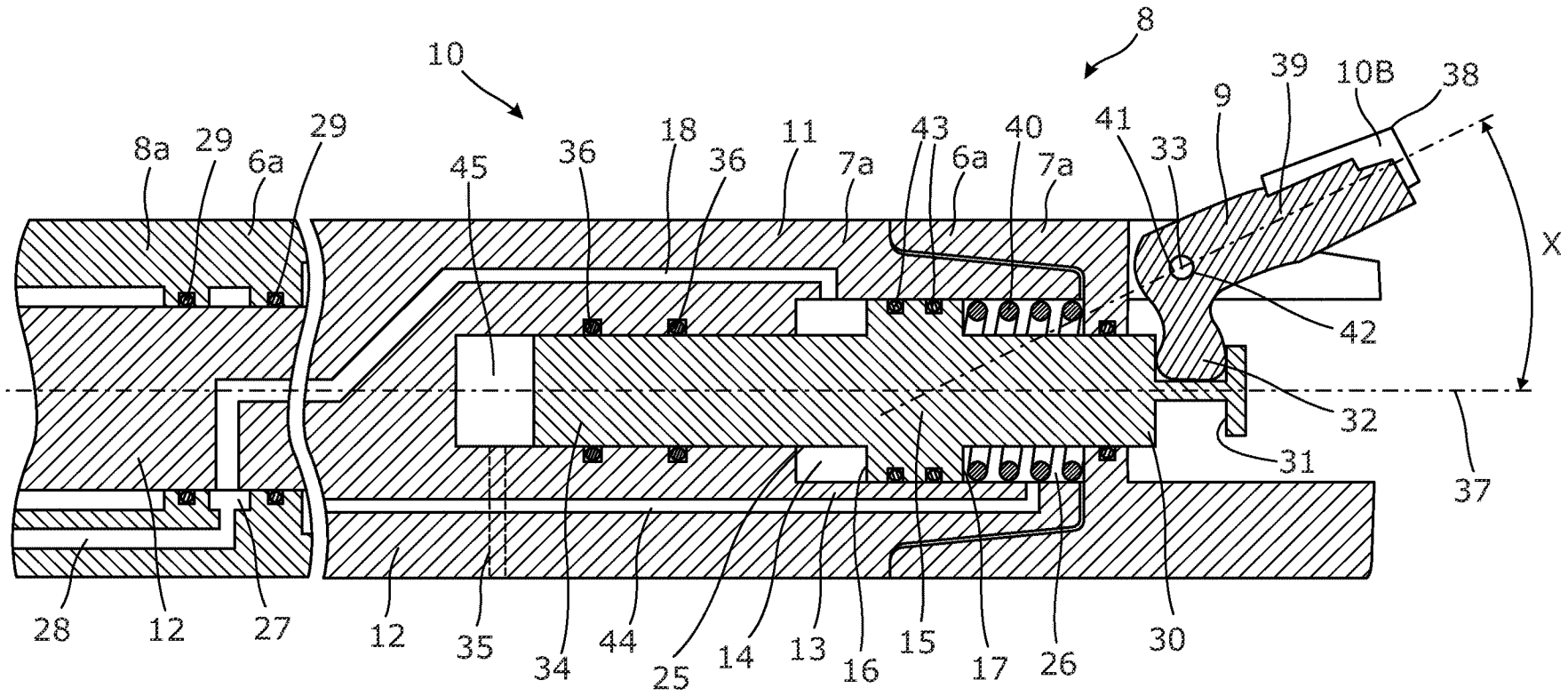

The invention and its many advantages will be described in more detail below with reference to the accompanying schematic drawings, which for the purpose of illustration show some non-limiting embodiments and in which:

FIG. 1 is a partially cross-sectional view of a well tubular metal structure in which a downhole tool is inserted for separating a first section of the well tubular metal structure from a second section, FIG. 2 is a partially cross-sectional view of the well tubular metal structure of FIG. 1 being separated into the first section and the second section, FIG. 3 is a partially cross-sectional view of the well tubular metal structure of FIG. 2 in which an unexpanded annular barrier has been inserted opposite an area between the first section and the second section, FIG. 4 is a partially cross-sectional view of the well tubular metal structure of FIG. 3 in which the annular barrier has been expanded by pressurising part of the well tubular metal structure by means of the downhole tool, FIG. 5 shows a partially cross-sectional view of the well tubular metal structure of FIG. 4 where the downhole tool has been removed, FIG. 6 is a partially cross-sectional view of another well tubular metal structure which has been separated by a circumferential cut dividing the well tubular metal structure into a first section and a second section, FIG. 7 is a partially cross-sectional view of the well tubular metal structure of FIG. 6 in which the first section has been pulled out of the well and an unexpanded annular barrier mounted at the end of the first section is run in the well, FIG. 8 is a partially cross-sectional view of the well tubular metal structure of FIG. 7 in which the annular barrier has been arranged at the predetermined position, FIG. 9 is a partially cross-sectional view of the well tubular metal structure of FIG. 8 in which the annular barrier has been expanded, FIG. 10 shows a partial view of a downhole tool surrounded by an expandable metal sleeve (shown in cross-section), FIG. 11 shows a partially cross-sectional view of another well tubular metal structure in which the tool of FIG. 10 has been arranged opposite the predetermined position and end parts of the expandable metal sleeve have been expanded, FIG. 12 is a partially cross-sectional view of the well tubular metal structure of FIG. 11 in which a part of the expandable metal sleeve intermediate the end parts has also been expanded by pressurised fluid from the tool, FIG. 13 is a cross-sectional view of the well tubular metal structure of FIG. 12 where the downhole tool has been removed, FIG. 14 shows a cross-sectional view of another annular barrier, and FIG. 15 shows a cross-sectional view of part of one embodiment of a downhole tool having projectable arms with cutting edge for machining into the wall of the well tubular metal structure.

All the figures are highly schematic and not necessarily to scale, and they show only those parts which are necessary in order to elucidate the invention, other parts being omitted or merely suggested.

FIG. 1 shows a first part of a downhole method for providing a zonal isolation at a predetermined position in an annulus 2 between a wall 3 of a borehole 4 and a well tubular metal structure 5 having a longitudinal extension in an existing well 1. FIG. 1 shows a partially cross-sectional view of the well tubular metal structure in which a downhole tool 10 is inserted for separating the first section 6 of the well tubular metal structure 5 from the second section 7. The downhole tool 10 is inserted in the well tubular metal structure and positioned opposite the predetermined position, and the separation of the first section 6 from the second section 7 of the well tubular metal structure by machining into and along a circumference of the well tubular metal structure is initiated.

As shown in FIG. 2, the separation comprises moving a machining device 8 of the downhole tool 10 upwards towards a top 51 of the well 1 and a milling or grinding part of the well tubular metal structure so that that part of the well tubular metal structure is removed leaving an open area between the first section 6 and the second section 7. Then, an unexpanded annular barrier 20 is inserted through the first section to the predetermined position between the first section and the second section as shown in FIG. 3, and as shown in FIG. 4, the annular barrier 20 is then expanded providing zonal isolation at the predetermined position. Subsequently, the downhole tool 10 is removed from the well as shown in FIG. 5. As can be seen, the downhole tool is a wireline downhole tool. The downhole tool may have a driving unit (not shown).

In FIG. 1, the downhole tool 10 comprises an electronic section 19 for controlling the electricity supply before being directed to a rotation unit, such as an electrical motor 60, driving a hydraulic pump 21. The downhole tool further comprises an anchor section 22 and a stroking tool 23 providing the movement along the longitudinal extension of the well tubular metal structure 5. The downhole tool 10 is submerged into the well tubular metal structure, and the anchor section 22 of the downhole tool is hydraulically activated to anchor a second part of the tool housing of the tool in relation to the well tubular metal structure 5. The motor is powered through a wireline 24 and the electronic section 19, and the motor drives the pump and rotates a rotatable shaft 12 for rotating the cutting arm 9 for separating the upper and first section 6 from the lower second section 7 of the well tubular metal structure 5. Thus, the downhole tool 10 is submerged into the well or the well tubular metal structure only by a wireline, e.g. with another kind of power supply line, such as an optical fibre, and not by tubing, such as coiled tubing, drill pipe or similar piping.

As shown in FIG. 2, the separation of the first section from the second section comprises the machining part of the well tubular metal structure over a predetermined distance d along the longitudinal extension L, thereby grinding the part of the well tubular metal structure into inconsiderably small pieces. Machining part of the well tubular metal structure is performed by cutting or milling a part of the well tubular metal structure in the longitudinal extension.

Separation of the first section 6 from the second section 7 may also comprise moving the first section 6 the predetermined distance d from the second section 7 after the machining.

In FIGS. 6-9, separation of the first section 6 from the second section 7 comprises pulling the first section 6 out of the borehole 4 after the machining. Then as shown in FIG. 7, the first section 6 is mounted with an annular barrier 20 and then inserted into the borehole 4, so that the first section 6 is arranged at a distance from the second section where the distance corresponds to the length of the annular barrier, so that the annular barrier abuts the second section 7.

In FIG. 3, the unexpanded annular barrier 20 is inserted by means of a downhole tool 10 and in FIG. 7, the unexpanded annular barrier 20 is inserted by means of the first section 6.

The annular barrier 20 comprises in FIGS. 3-5 and 7-9 a tubular metal part 52, an expandable metal sleeve 53 surrounding and connected to the tubular metal part providing an annular space 54 between the tubular metal part/well tubular metal structure and the expandable metal sleeve 53. The tubular metal part 52 has an expansion opening 55 in order to expand the expandable metal sleeve 53.

The downhole tool 10 may comprise isolation means 61 (shown in FIGS. 10-12) for isolating a part of the tubular metal part 52 of the annular barrier 20 from within in order to pressurise the tubular metal part from within. The expandable metal sleeve 53 of the annular barrier is thus expanded abutting at least the borehole wall but may also be designed for abutting the inner face of the first section 6, the inner face of the second section, and the borehole wall in order to isolate there between. Thus, sealing means (shown in the annular barrier of FIG. 10) may be provided on the outer face of the expandable metal sleeve to enhance the sealing ability between the expandable metal sleeve and the inner face of the first and second sections.

In FIGS. 10-14, the annular barrier comprises an expandable metal sleeve 53 but does not surround a tubular metal part, as the annular barrier is baseless having only the expandable metal sleeve.

The annular barrier can be expanded in different ways. The annular barrier may be expanded by pressurising at least a part of the well tubular metal structure opposite the expansion opening and letting fluid into the annular space for expanding the expandable metal sleeve, e.g. by a tool 10 as shown in FIG. 4 or by plugging (e.g. dropping a ball into a ball seat) the well tubular metal structure below the annular barrier and pressurising the well tubular metal structure from surface.

In another embodiment, expanding the annular barrier is performed by expanding the tubular metal part and/or the expandable metal sleeve, e.g. by pulling an expandable cone or a mandrel through the tubular metal part, or if no tubular metal part is present by directly expanding the expandable metal sleeve to abut the inner face of the well tubular metal structure overlapping the first section and the second section. Subsequently, the expandable metal sleeve is further expanded by pressuring the expandable metal sleeve from within e.g. by isolating an intermediate part 58 of the expandable metal sleeve as shown in FIG. 12.

In FIG. 11, each of the ends 56, 57 of the expandable metal sleeve 53 is radially expanded by an expandable bladder 61 so that one end 56 is overlapping the first section 6, and the other end 57 is overlapping the second section 7. Subsequently, fluid is pumped out through tool openings 63 in the tool 10, expanding the expandable metal sleeve between the first section and the second section to abut the wall 3 of the borehole 4. Thus, the annular barrier 20 has a first barrier end 66 and a second barrier end 67, where the first barrier end is configured to overlap the first section 6 and the second barrier end 67 is configured to overlap the second section 7. In order to enhance the sealing ability of the ends of the annular barrier, sealing elements may be arranged surrounding the outer face of the annular barrier ends as shown in FIGS. 10-13.

As shown in FIG. 14, the expandable metal sleeve 53 comprises sealing elements 64 and split ring-shaped elements 65 for back-up of the sealing element 64. An intermediate element 69 is provided between the sealing element 64 and the split ring-shaped elements 65. The sealing elements, the split ring-shaped elements 65 and the intermediate elements are arranged between two projections 71 forming a groove 72.

In FIG. 3, the downhole system 100 is shown comprising the well tubular metal structure 5, the annular barrier 20, and the downhole tool 10.

Even though not shown, the downhole method may further comprise providing a second zonal isolation at a second predetermined position in the annulus between the wall of the borehole and the well tubular metal structure. The first and second annular barriers provided at the first and second predetermined positions may be expanded in one run or two runs. The downhole tool may have means for holding a section of the well tubular metal structure in relation to a second section of the well tubular metal structure by having two anchoring sections 22.

The downhole tool 10 providing the separation of the first section from the second section may be the same tool providing and expanding the annular barrier so that the operation may be performed in one run instead of the two runs as shown in FIGS. 1-4.

As shown in FIG. 15, the downhole tool 10 comprises a tool housing 6*a* having a first housing part 7*a* and a second housing part 8*a* and a cutting arm 9 being pivotably connected with the first housing part and having a cutting edge 10 in a first end. The arm 9 is movable between a retracted position and a projected position in relation to the tool housing. The arm is shown in its projected position in FIG. 15. The tool further comprises an arm activation assembly 11 for moving the cutting arm 9 between the retracted position and the projected position. A rotatable shaft 12 penetrates the second housing part 8*a* and is connected with, and forms part of, the first housing part for rotating the cutting arm.

The arm activation assembly 11 comprises a piston housing 13 arranged in the first housing part 7*a* and comprises a piston chamber 14. A piston member 15 is arranged inside the piston chamber and engages with the cutting arm 9, thereby moving the cutting arm 9 between the retracted position and the projected position. The piston member 15 is movable in a longitudinal direction of the downhole tubing cutter tool and has a first piston face 16 and a second piston face 17. Hydraulic fluid from the pump is pumped into a first chamber section 25 of the chamber 14 through a first fluid channel 18, applying a hydraulic pressure on the first piston face 16, moving the piston in a first direction, applying a projecting force on the cutting arm 9.

When the cutting arm is projected to press a cutting edge 10B against an inner face of the well tubular metal structure, and when the cutting arm is simultaneously rotated by the motor through the rotatable shaft, the cutting edge 10B is capable of cutting through the well tubular metal structure. Hereby, it is obtained that a first section of the well tubular metal structure can be separated from a second section of the well tubular metal.

In FIG. 15, the rotatable shaft 12 supplies the fluid to the first section 25 of the chamber 14. The fluid from the pump is supplied to the shaft 12 through a circumferential groove 27 fluidly connected with a second fluid channel 28 in the second housing part 8*a*. Thus, the fluid from the second fluid channel 28 is distributed in the circumferential groove 27 so that the first fluid channel 18 in the rotatable shaft 12 is always supplied with pressurised fluid from the pump while rotating. The circumferential groove 27 is sealed off by means of circumferential seals 29, such as O-rings, on both sides of the circumferential groove 27.

The piston member 15 moves in the longitudinal direction of the tool 10 inside the piston chamber and divides the chamber 14 into a first chamber section 25 and a second chamber section 26. When the piston member moves in the first direction, a spring member 40 abutting the second piston face 17 opposite the first piston face 16 is compressed. As the spring member is compressed, so is the second chamber section, and the fluid therein flows out through a fourth channel 44 fluidly connected with the first channel 18. The spring member, which is a helical spring surrounding part of the piston member arranged in the second chamber section 26, is thus compressed between the second piston face 17 and the piston chamber 14. The piston member has a first end 30 extending out of the piston housing 13 and engaging the cutting arm by having a circumferential groove 31 into which a second end 32 of the cutting arm extends. The second end of the cutting arm is rounded to be able to rotate in the groove. The cutting arm is pivotably connected with the first housing around a pivot point 33. In the other and second end 34 of the piston member, the piston member extends into the shaft 12. When the piston member is moved in the first direction, a space 45 is created between the second end 34 of the piston member and the shaft. This space 45 is in fluid communication with the well fluid through a third channel 35, which is illustrated by a dotted line. In this way, the piston does not have to overcome the pressure surrounding the tool in the well. The second end 34 of the piston member is provided with two circumferential seals 36 in order to seal off the piston chamber from the dirty well fluid.

When the cutting operation is complete, and the well tubular metal structure has been separated into an upper and a lower part, the hydraulic pressure from the pump is no longer fed into the first channel, and the spring member forces the piston member 15 in a second direction opposite the first direction along the longitudinal direction 37 of the tool, as indicated in FIG. 15. The arm activation assembly may be powered by the pump as shown or driven by the motor.

The downhole method may further comprise providing cement on top of the annular barrier to provide an abandonment plug. By providing a plug e.g. of cement within the well tubular metal structure, the well can then be abandoned.

A stroking tool 23 is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and may simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a driving unit such as a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole method for providing a zonal isolation at a predetermined position in an annulus between a wall of a borehole and a well tubular metal structure having a longitudinal extension in an existing well, comprising:

inserting a downhole tool in the well tubular metal structure, positioning the downhole tool opposite the predetermined position, separating a first section of the well tubular metal structure from a second section of the well tubular metal structure by machining into and along a circumference of the well tubular metal structure, forming an annular gap along the longitudinal extension between the first section and the second section, inserting an unexpanded annular barrier between the first section and the second section that is aligned with the annular gap, expanding the annular barrier through the annular gap, from within the well tubular metal structure to a position that is at least partly into annulus, for providing zonal isolation at the predetermined position.

2. A downhole method according to claim 1, wherein separating the first section from the second section comprises machining part of the well tubular metal structure over a predetermined distance along the longitudinal extension.

3. A downhole method according to claim 2, wherein inserting the unexpanded annular barrier is performed by a downhole tool.

4. A downhole method according to claim 1, wherein separating the first section from the second section comprises moving the first section from the second section after the machining.

5. A downhole method according to claim 1, wherein separating the first section from the second section comprises pulling the first section out of the borehole after the machining.

6. A downhole method according to claim 5, further comprising inserting the first section in the borehole at a distance from the second section.

7. A downhole method according to claim 5, wherein inserting the unexpanded annular barrier is performed by mounting the unexpanded annular barrier at an end of the first section.

8. A downhole method according to claim 1, wherein the annular barrier comprises a tubular metal part, an expandable metal sleeve connected with and surrounding the tubular metal part providing an annular space between the tubular metal structure and the expandable metal sleeve, the tubular metal part having an expansion opening.

9. A downhole method according to claim 8, wherein expanding the annular barrier is performed by expanding the tubular metal part and/or the expandable metal sleeve.

10. A downhole method according to claim 8, wherein expanding the annular barrier is performed by means of a mandrel and/or an expandable bladder.

11. A downhole method according to claim 8, wherein the expandable metal sleeve is radially expanded between the first section and the second section to abut the wall of the borehole.

12. A downhole method according to claim 1, wherein the annular barrier comprises an expandable metal sleeve.

13. A downhole method according to claim 1, wherein the annular barrier has a first barrier end and a second barrier end, the first barrier end being configured to overlap the first section, and the second barrier end being configured to overlap the second section.

14. A downhole method according to claim 1 further comprising providing a second zonal isolation at a second predetermined position in the annulus between the wall of the borehole and the well tubular metal structure.

15. A downhole system for providing a zonal isolation at a predetermined position in an annulus between a wall of a borehole and a well tubular metal structure having a longitudinal extension in an existing well, comprising:

the well tubular metal structure arranged in the borehole, a downhole tool inserted in the well tubular metal structure and positioned opposite the predetermined position for separating by an annular gap along the extension a first section of the well tubular metal structure from a second section of the well tubular metal structure by machining into and along a circumference of the well tubular metal structure, and an annular barrier aligned with the annular gap and arranged between the first section and the second section and being expanded through the annular gap for providing zonal isolation at the predetermined position.

* * * * *